US005775444A

United States Patent [19]

Falgout, Sr.

[11] Patent Number: 5,775,444

[45] Date of Patent: Jul. 7, 1998

[54] DRILL STRING ORIENTING MOTOR

[76] Inventor: Thomas E. Falgout, Sr., 110 Charles Read St., Lafayette, La. 70503

[21] Appl. No.: 735,738

[22] Filed: Oct. 23, 1996

[51] Int. Cl.[6] ..... E21B 17/07

[52] U.S. Cl. ..... 175/322; 175/74

[58] Field of Search ..... 175/322, 107, 175/74, 323, 343, 348, 228

[56] References Cited

U.S. PATENT DOCUMENTS

| | | | |
|---|---|---|---|
| 1,641,206 | 9/1927 | Smith | 175/322 |
| 1,817,067 | 8/1931 | Crowell | 175/322 X |
| 3,747,698 | 7/1973 | Chapman | 175/92 |
| 5,117,927 | 6/1992 | Askew | 175/61 |
| 5,156,223 | 10/1992 | Hipp | 175/296 |
| 5,404,944 | 4/1995 | Lynde et al. | 166/117.7 |
| 5,454,420 | 10/1995 | Snider et al. | 166/381 |
| 5,669,457 | 9/1997 | Sebastian et al. | 175/73 |
| 5,673,765 | 10/1997 | Wattenburg et al. | 175/322 |

*Primary Examiner*—Frank Tsay
*Attorney, Agent, or Firm*—John D. Jeter

[57] ABSTRACT

The housing of the orienting motor serves as a length of pipe string and rotates the lower end relative to the upper end. Rotation is in preselected increments each time the rate of fluid flow in the pipe string is changed between preselected limits. Once rotated an increment the housing is rotationally locked as long as flow rate is maintained greater than a preselected amount. When fluid flow is stopped, the actuation system resets, in time, to the starting position but a one way clutch retains the previous rotational relationship between opposite ends of the housing. Resetting time is adjustable to permit a preselected activity period before flow restart without further changes in the orienting action.

10 Claims, 2 Drawing Sheets

DRILL STRING ORIENTING MOTOR

This invention pertains to a motor for use near the lower end of a pipe string in a well bore to rotate the lower end of the drill string relative to its upper end. More specifically, the motor is generally for use in a string of coiled tubing, used in a well bore, to rotate the lower end of the string in controlled increments to rotationally orient the lower end of the string relative to earth.

BACKGROUND OF THE INVENTION

When coiled tubing is used at a well site to be partially unspooled to provide a length of pipe for insertion into a well bore the lower end of the pipe becomes rotationally stationary relative to earth. To rotate the lower end of the pipe relative to earth the entire coil of pipe would have to progress peripherally around the well axis and that is considered impractical. Rotating the axis of the massive coil about a line transverse to its rotational axis would rotate the lower end relative to earth but that too is impractical. An acceptable alternative is to rotate the lower end of the pipe string with an orienting motor located near the string elements requiring earth related orientation. Such elements requiring orientation are usually drill bit driving motors with axis bending apparatus or other lower end powered tools.

The lower end of directional drilling and workover strings requiring earth orientation are normally monitored by Measurement While Drilling (MWD) instrumentation. That activity may require electrical conductors to penetrate the orienting motor to monitor the situation of string components below the motor. That requirement has guided the design of the present invention and no functional element has been placed in the generally central path that may be needed, requiring central bore holes and the like. No such contrivance is provided because different users have different requirements and those requirements change frequently.

It is therefore an object of this invention to provide an orienting motor for the lower end of the drill string that can be rotated in increments each time the fluid flow down the string bore is changed between preselected limits, under preselected conditions.

It is yet another object of this invention to provide apparatus to respond to pressure differences produced along the flow path of fluid flowing down the string bore, and the apparatus, to actuate the incremental rotational stepping features of the apparatus.

It is another object of this invention to provide apparatus that will act as a hydrostatic motor to positively rotate one end relative to the other in proportion to the amount of fluid moved down the drill string bore until a preselected increment of rotation is realized, then become hydrodynamic to allow fluid to flow through without further movement of the orienting action.

It is yet a further object of this invention to provide apparatus to respond to the pressure difference between the fluid flowing down the string bore and the environment outside the string to actuate the incremental rotational stepping features of the apparatus.

It is still another object of this invention to provide apparatus to lock opposite ends of the orienting motor against relative rotation in either direction while fluid flows through the housing at a rate greater than a preselected amount.

These and other objects, advantages, and features of this invention will be apparent to those skilled in the art from a consideration of this specification, including the attached claims and appended drawings.

SUMMARY OF THE INVENTION

An orienting motor is situated in a body usable as a length element of a pipe string with provisions to power the motor orienting movements by fluid flowing therethrough. The body has means at both ends for fluid tight attachment to the continuing pipe string. The body comprises two components, a housing and an arbor which extends from and is telescopingly received therein, with fluid tight sealing provisions therebetween. The two ends are axially constrained and bearingly supported for rotation of one end relative to the other.

The housing has cylindrical bore provisions to carry a piston arranged for rotational constraint and axial movement therein in response to the flow of fluid along the string bore and through the motor. The piston has a valve controlled by-pass channel to allow fluid to flow axially through the motor. The valve is controlled by movement of the piston and when it is closed the piston must move in response to movement of fluid down the drill string bore. Near the end of the piston stroke the valve opens and resistance in the by pass channel can produce enough pressure to hold the piston fully down. A resistor piston is attached to the main piston and has ports to permit but resist flow of fluid through the motor to produce thrust against the operating rod after the by pass valve is opened. When the flow rate is advanced to the usual operational drilling rate, the resistance piston provides enough force to maintain the operating rod at the limit of travel. The by pass ports open between the pistons.

The operation of the valve produces changes in pressure drop through the motor that can be detected at the surface to verify orienting action. The first flow through the motor operates the positive displacement cylinder and the flow rate can be quite low. When the by pass valve opens, pressure drops at the stand pipe and the driller, assured of orienting action, can proceed with operational drilling activity. The resulting flow rate increase holds the piston down.

An axial to rotary motion converter converts axial movement of the piston, and an attached operating rod, to rotary movement of a cooperating driven member which is, preferably, the arbor itself. That is a spiral groove and cam lug arrangement. A jaw clutch is actuated by the first hydrostatically driven motion of the piston and positively drives the converter. Near the end of the travel of the piston the rotational drive ceases to consume power because the grooves are shaped to effectively stop further rotary drive and the by pass valve opens. Resistance through the by pass holds the now lightly loaded piston at the end of its travel limit. The jaw clutch rotationally locks the driver end of the converter to the arbor but allows enough free movement to allow a one way clutch to receive the torque conducted through the body.

A one way clutch arrangement operates between opposite ends of the body to secure the rotation already achieved. The jaw clutch disengages when the piston starts an upstroke. This allows the axial to rotary movement converter to free wheel backwards as it returns to the starting position without reversing the rotation achieved between ends of the housing.

BRIEF DESCRIPTION OF DRAWINGS

In the drawings wherein like features have similar captions.

DETAILED DESCRIPTION OF DRAWINGS

Figure 1:
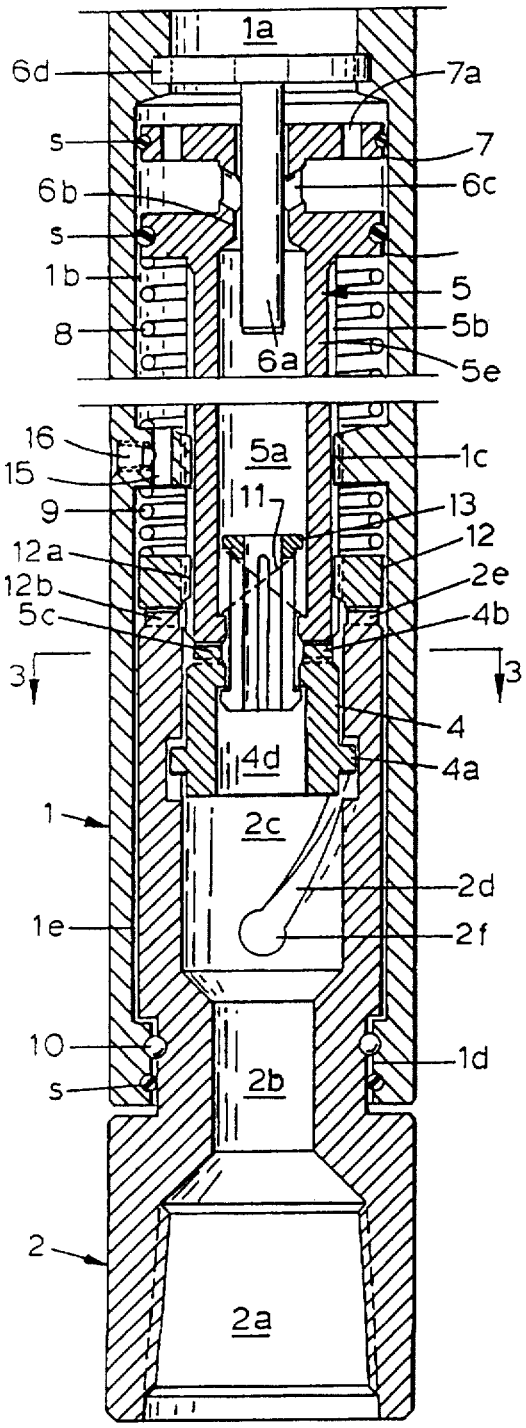
FIG. 1 is a side view, mostly cut away, of the preferred embodiment of the invention.

In the drawings certain features well established in the art and not bearing upon points of novelty are omitted in the interest of descriptive clarity. Such omitted features may include some threaded joining lines, weld lines, some threaded fasteners, pins and the like.

In FIG. 1 the overall body is comprised of housing 1 and arbor 2, and is usable as a length of drill pipe. It has means at the top (not shown) for fluid tight attachment to an upwardly continuing drill string and tool joint box 2*a* at the bottom for fluid tight attachment to a downwardly continuing portion of the drill string. Fluid channels are provided in the body to conduct fluid between the upwardly and downwardly continuing portions of the drill string.

Some brief functional and structural descriptions will enhance understanding of detailed descriptive matter to follow. An effective power cylinder is comprised of housing bore 1*b* in cooperation with actuator 5 made up of pistons 3 and 7 attached to actuator rod 5*e*. A bypass valve is comprised of rod 6*a* in cooperation with orifice 6*b*. With the valve closed piston 3 responds to pressure in channel 1*a* regardless of flow rate. The valve is opened by downward movement of actuator 5. When the valve is opened, the flow is through open spider plate 6*d*, resistor ports 7*a* vent port 6*c* and bore 5*a*. The pressure change through resistor ports 7*a* provides force for piston 7 and that pressure is related to flow rate. Drilling torque is transmitted through the body by way of female splines 1*c*, male splines 5*b*, female splines 12*a*, clutch teeth 12*b* and 2*e* and the arbor 2. A jaw clutch is formed of teeth 5*c* on actuator 5 and mating teeth 4*b* on motion converter 4. Collet 13 and spring 11 keep the converter 4 from falling down or advancing freely along bore 2*c* ahead of actuator 5. Areas needing some degree of sealing are labeled s. Spring 8 returns the actuator 5 to the upward travel limit. Spring 9 loads clutch ring 12.

Figure 2:
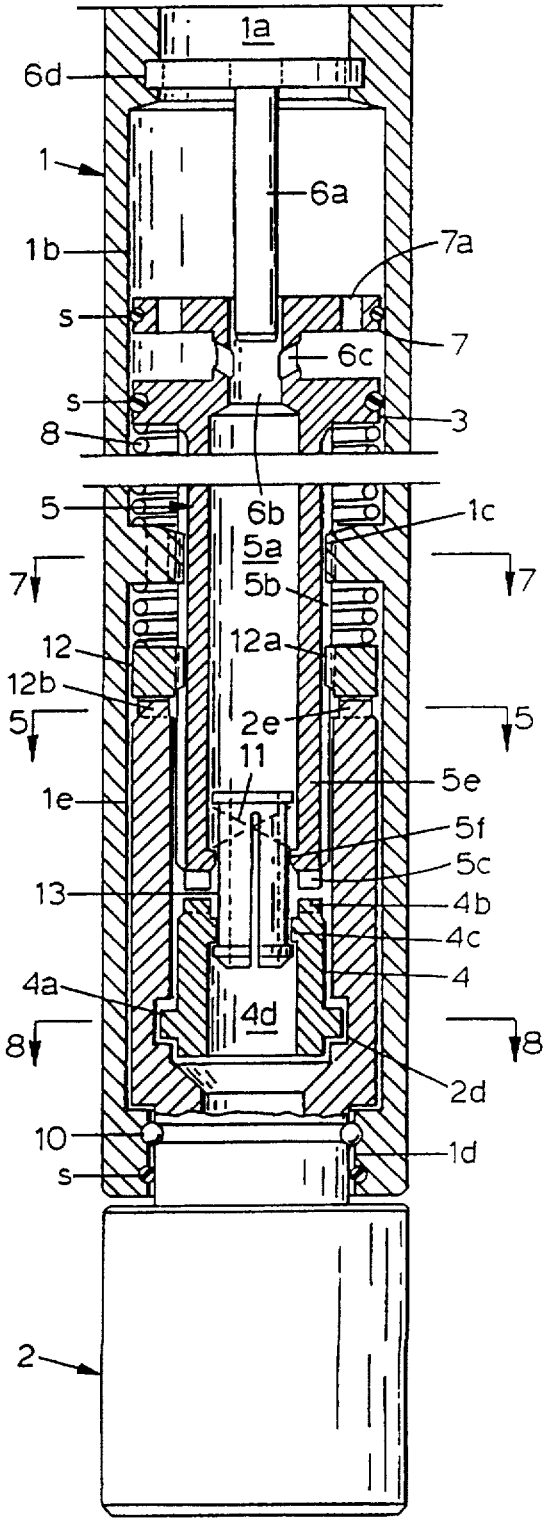
FIG. 2 is similar to FIG. 1 with some of the machine elements in alternate operational positions.

FIG. 1 shows the motor just after the onset of fluid flow, with the actuator 5 moved down enough to engage clutch teeth 4*b* and 5*c* but otherwise in the starting or neutral position. FIG. 2 shows the motor after an actuation excursion, which may have including a drilling interval, just after flow has been stopped and the piston has just begun to move upward disengaging clutch teeth 4*b* and 5*c*.

Housing 1 has bore 1*a* to receive fluid from the drill string, bore 1*b* to carry a piston, splined bore 1*c* to carry a splined operating rod, bore 1*e* to telescopingly receive the upper portion of the arbor, and bore 1*d* to carry bearings 10 and seal s.

Arbor 2 is bearingly supported in housing 1 by bearing 10 for axial constraint and rotary motion. Tool joint box 2*a* has fluid channel 2*b* to deliver fluid from the body to the downwardly continuing drill string. Bore 2*c* receives axial to rotary motion converter 4 which is bearingly supported for axial movement with cam lugs 4*a* extending into spiral slot 2*d*. The upper end of the arbor has clutch teeth 2*e* to provide part of a one way clutch to engage teeth 12*b* on rotationally stationary ring 12.

Piston 3, in bore 1*b*, is connected to operating rod 5 which is made non rotational by splines 5*b* engagement with mating splines 1*c* on the housing. These splines also engage ring 12 by way of internal splines 12*a*. The lower end of the operating rod has clutch jaws 5*c* which engage mating jaws 4*b* to hold motion converter 4 rotationally stationary when the clutch is engaged.

In FIG. 1, the actuator has just started to move downward. Before downward movement started, clutch jaws 5*c* and 4*b* were separated as shown in FIG. 2. Collet 11 is arranged in bores 4*d* and 5*a* to allow the jaws to separate but it does not allow the converter 4 to fall away when the operating rod rises.

When the actuator moves downward, jaws 4*b* and 5*c* engage and the arbor is driven rotationally by cam lugs 4*a* in spiral grooves 2*d*. This is a clockwise rotation, viewed from the top, and the teeth 2*e* and 12*b* are of such saw tooth shape that the arbor is allowed to rotate in that direction only.

The motor is arranged to lock against both directions of rotation when operational drilling fluid flow rates exist. The piston 3, in conjunction with resistor piston 7 and valve rod 6*a*, provides a combination of hydrostatic and hydrodynamic actuation. When the piston is in the upward location, rod 6*a* closes port 6*b* and the piston must move down, as a hydrostatic driver, if fluid moves down the drill string bore. When the piston has moved down enough for rod 6*a* to clear port 6*b* fluid can flow through resistor ports 7*a*, ports 6*c* through port 6*b* and downward through the motor to any drill string continuing below. The positive drive portion of the downward movement of the piston does most of the rotational work by moving converter 4 near its lower limit of travel. When rod 6*a* clears port 6*b*, the flow resistance of ports 7*a* are such as to hold the jaws 2*e* and 4*b* engaged to lock the arbor 2 in both rotational directions while drilling activity continues. The opened recess 2*f* at the end of groove 2*d* allows the arbor enough rotational slack for the teeth 2*e* and 12*b* to engage to provide torque carrying capacity through the body. Cam lugs 4*a* in recess 2*f* insure against forward movement of the arbor. That can happen due to crank effect of bent drill strings in crooked well bores.

The design of the valve comprising rod 6*a* and port 6*b* offers a choice of resetting options. If the valve is a positively closed system, the motor will not reset during addition of drill string sections when circulation is stopped. It will reset only by brief reversal of circulation. With slight leakage through the valve, the motor will slowly reset when circulation is stopped. If sufficient time is allowed for the motor to reset, it will advance another increment of rotation when circulation is resumed. If new section connections are made at the surface in a brief amount of time the motor will not reset when circulation is resumed. Clearance between rod 6*a* and port 6*b* determines leakage rate and, hence, the allowable connection time at the surface without a reset.

Copious vent galleries are in the art and not shown but vent 15 is shown on FIG. 1 only to illustrate plugged vent 16. With this plug removed the pressure reference downstream of piston 3 is outside the pipe string and enables reduction of pressure losses through ports 7*a* if sufficient flow losses are natural to any assembly downstream of the motor.

Figure 3:
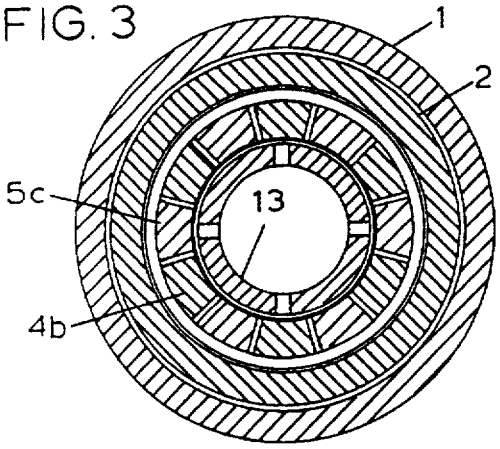
FIG. 3 is a sectional view, somewhat enlarged, taken along line 3—3 of FIG. 1.

FIG. 3 is a sectional view taken along line 3—3 of FIG. 1. It is enlarged and shows the relationship between jaw teeth 4*b* and 5*c*.

Figure 4:
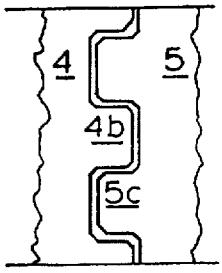
FIG. 4 is a development of selected surfaces of FIG. 3 viewed toward the axis.

FIG. 4 is a development of the surfaces viewed toward the centerline, showing the interdigitating nature of jaw teeth 4*b* and 5*c*.

Figure 5:
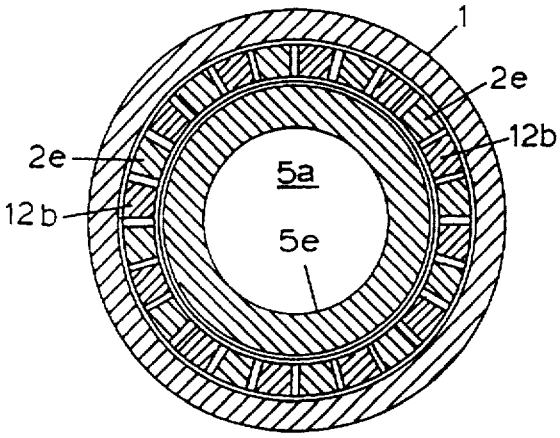
FIG. 5 is a sectional view, somewhat enlarged, taken along line 5—5 of FIG. 2.

FIG. 5 is a sectional view of the one way clutch taken along line 5—5 of FIG. 2. and shows the relationship between saw teeth 2*e* and 12*b*.

Figure 6:
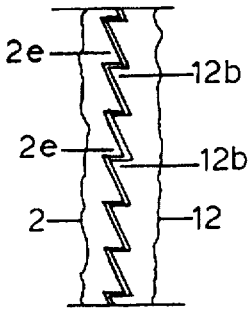
FIG. 6 is a development of selected surfaces of FIG. 5 viewed toward the axis.

FIG. 6 is a development of the surface of FIG. 5 viewed toward the centerline. The teeth 2*e* and 12*b* are oriented to cause the arbor 2 to rotate only clockwise, viewed from above.

Figure 7:
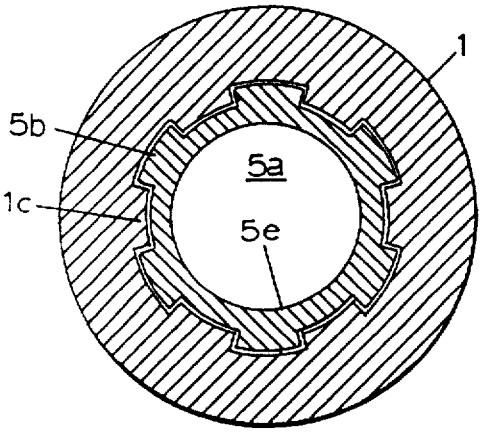
FIG. 7 is a sectional view, somewhat enlarged, taken along line 7—7 of FIG. 2.

FIG. 7 is a section, somewhat enlarged, taken along line 7—7, FIG. 2. Teeth 1*c* are normally cut in the bore of a bore reduction ring secured within the body but for simplicity is shown cut into the bore reduction in the housing. Mating spline teeth 5*b* run nearly the full length of operating rod 5 and effectively rotationally secure clutch ring 12 to housing 1.

Figure 8:
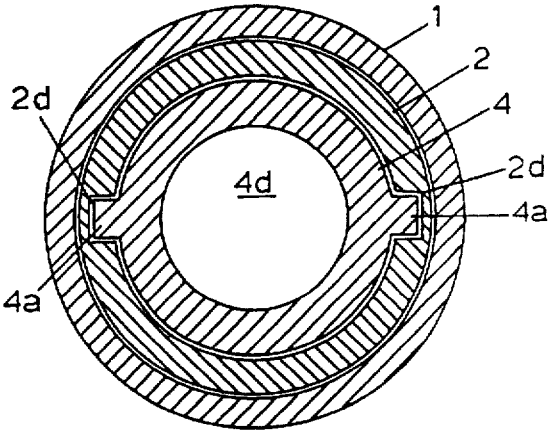
FIG. 8 is a sectional, somewhat enlarged, view taken along line 8—8 of FIG. 2.

FIG. 8 is a section, somewhat enlarged, taken along line 8—8 of FIG. 2 and shows the relationship between cam lugs 4*a* and spiral grooves 2*d*.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. An orienting motor, usable as a length element of a continuing pipe string, to incrementally rotate one end of said pipe string relative to the other in response to preselected flow rate changes in a stream of fluid pumped down the pipe string bore, the motor comprising:

a) an elongated body comprising a housing on one end and an arbor on the opposite end, said housing telescopingly receiving said arbor for fluid tight relative rotation and axial constraint, means at each said end for fluid tight attachment to the continuing pipe string components and at least one channel to conduct fluid between attached said components;

b) actuator means situated in said housing, responsive to pressure difference between opposite ends of said body to move axially between first, second, and third positions, with spring bias to return said actuator to said first position;

c) an axial to rotary motion converter movable in response to movement of said actuator to rotate said arbor relative to said housing an incremental amount each time said actuator moves in at least one direction between said first two positions;

d) a one way clutch situated to operate between said housing and said arbor to retain said incremental amount of rotation;

e) a clutch situated to transmit torque between said actuator and said converter and responsive to the direction of movement of said actuator to engage when said actuator moves away from said first position and to disengage when said actuator moves toward said first position.

2. The motor of claim 1 wherein a valve is situated in said channel, responsive to the position of said actuator to be closed when said actuator is between said first and said second position and to be open when said actuator is between said second and said third positions.

3. The motor of claim 1 wherein said converter comprises a cam lug that operates in cooperation with a spiral groove, said groove shaped such that said rotation takes place when said actuator moves between said first and said second positions.

4. The motor of claim 1 wherein said clutch is a jaw clutch and said actuator is rotationally secured for said axial movement relative to said housing.

5. An orienting motor, usable as a length of pipe string, powered by fluid pumped down the bore of an attached pipe string for rotationally advancing one end of said motor relative to the other end in a selected direction a preselected number of degrees each time the flow rate of fluid moving down the string bore is changed between preselected limits, the motor comprising:

a) an elongated body for use as a length of pipe string with means at each end for fluid tight attachment to portions of the continuing pipe string, comprising an arbor and a housing, said housing to telescopingly receive and bearingly support said arbor for axial constraint and relative rotation with fluid tight sealing means therebetween, said arbor to sealingly extend from said housing as one end of said body;

b) at least one valve controlled fluid channel extending between said fluid tight attachments;

c) a power cylinder comprising piston means, with attached actuator extension, sealingly situated for axial movement between first, second, and third positions in a bore in said housing, with opposite sides of said piston in fluid communication with opposite flow related ends of said channel, said piston spring biased toward said first position and responsive to flow induced pressure difference in said channel to urge said piston away from said first position;

d) said valve arranged to at least partially open and close said channel in response to movement of said piston, said valve to be closed when said piston is in said first position and to be open when said piston is in said second and third positions;

e) motion converter means comprising at least one cam and spiral groove arrangement responsive to axial movement of said actuator to convert axial movement of said actuator to proportional rotary movement of said arbor;

f) a one way clutch situated to rotationally secure said housing to said arbor to allow said arbor to rotate only in said direction relative to said housing; and g) a jaw clutch, situated to rotationally connect said housing to said converter means, responsive to the direction of axial movement of said piston to engage when said piston moves from said first position and to disengage when said piston moves toward said first position.

6. The motor of claim 5 wherein said valve comprises a rod, axially secured to said housing, and a cooperating orifice in said piston, said orifice comprising part of said channel.

7. The motor of claim 5 wherein said converter comprises at least one said spiral groove in a bore in said arbor, said groove shaped to impart relative rotary motion between said arbor and said converter when said actuator moves to and from said first and second positions.

8. The motor of claim 5 wherein said jaw clutch and said actuator extension are rotationally secured for said axial movement relative to said housing.

9. The motor of claim 5 wherein said motion converter comprises said spiral grooves in a bore in said arbor, said cam lugs being held non rotational by a splined relationship between said actuator extension and said housing.

10. An orienting motor, usable as a length element of a continuing pipe string, to incrementally rotate one end of said pipe string relative to the other in response to preselected flow rate changes in a stream of fluid pumped down the pipe string bore, the motor comprising: a body having a housing on one end and an arbor on the other with means on each said end for fluid tight attachment to a continuing pipe string, with a fluid channel extending between said attachments, said arbor telescopingly received within said housing for fluid tight rotation and axial constraint therein, the incremental rotation achieved by movement of a piston in said housing driving an axial to rotary motion converter by way of a jaw clutch rotationally secured to said housing, said converter having cam lugs to engage spiral grooves in a bore in said arbor to rotate said arbor relative to said housing when said piston, spring biased to a first position, moves to a second position in response to fluid pressure difference between ends of said channel which extends through an orifice in said piston, said channel controlled by a valve rod attached to said housing and extending into said orifice to block said flow until said piston moves to said second position said jaw clutch arranged to disengage when said piston moves toward said first position, said rotation secured by a one way clutch situated to transmit torque between said housing and said arbor.

* * * * *